US009902589B2

(12) United States Patent
Gregory et al.

(10) Patent No.: US 9,902,589 B2
(45) Date of Patent: Feb. 27, 2018

(54) CORD WINDER AND RAIL STORAGE SYSTEM

(71) Applicant: Rubbermaid Incorporated, Huntersville, NC (US)

(72) Inventors: Michael Gregory, Huntersville, NC (US); Jordan Lay, Charlotte, NC (US); Robert J. Warner, Jr., Charlotte, NC (US)

(73) Assignee: RUBBERMAID INCORPORATED, Huntersville, NC (US)

( * ) Notice: Subject to any disclaimer, the term of this patent is extended or adjusted under 35 U.S.C. 154(b) by 203 days.

(21) Appl. No.: 13/647,633

(22) Filed: Oct. 9, 2012

(65) Prior Publication Data

US 2013/0092781 A1 Apr. 18, 2013

Related U.S. Application Data

(60) Provisional application No. 61/546,721, filed on Oct. 13, 2011.

(51) Int. Cl.
*B65H 75/44* (2006.01)
*B65H 54/58* (2006.01)

(52) U.S. Cl.
CPC ..... *B65H 75/446* (2013.01); *B65H 54/585* (2013.01); *B65H 75/4468* (2013.01); *B65H 75/4492* (2013.01)

(58) Field of Classification Search
CPC .. B65H 54/585; B65H 75/406; B65H 75/446; B65H 75/4468; B65H 75/4476; B65H 49/30; B65H 49/32; B65H 2402/412; A47F 5/0846
USPC .... 242/400.1, 404.3, 405.1–405.3, 406, 407, 242/604, 395
See application file for complete search history.

(56) References Cited

U.S. PATENT DOCUMENTS

| | | | | | |
|---|---|---|---|---|---|
| 69,579 | A | * | 10/1867 | Palmer | 242/399 |
| 146,558 | A | * | 1/1874 | Totten | 242/577.3 |
| 151,612 | A | * | 6/1874 | Norton | 242/407 |
| 483,830 | A | * | 10/1892 | Buchanan | 242/574.4 |
| 538,939 | A | * | 5/1895 | Warren et al. | 242/574.4 |
| 577,290 | A | * | 2/1897 | Evans | 111/35 |
| 584,264 | A | * | 6/1897 | Elder | B65H 75/24 242/404.2 |
| 593,745 | A | * | 11/1897 | Hughes | 242/405.2 |
| 742,296 | A | * | 10/1903 | Delphey | 242/423.1 |
| 851,770 | A | * | 4/1907 | Nichols | 242/395 |
| 892,349 | A | * | 6/1908 | Bailey | 242/405.3 |
| 939,616 | A | * | 11/1909 | Murphey | 242/391.2 |
| 1,014,322 | A | * | 1/1912 | Molcar | 242/395 |
| 1,108,726 | A | * | 8/1914 | Eichhoff | 242/397.2 |
| 1,127,017 | A | * | 2/1915 | Kidder et al. | 607/150 |
| 1,186,027 | A | * | 6/1916 | Olson | 242/591 |

(Continued)

*Primary Examiner* — Michael E Gallion
(74) *Attorney, Agent, or Firm* — Marshall, Gerstein & Borun LLP

(57) ABSTRACT

A winder accessory comprises a gripper assembly adapted to be releasably attached to a rail. A cord winder mechanism is supported on the gripper and comprises a spooling mechanism for winding a cord. The spool mechanism rotates on a rotating joint about a first axis of rotation relative to the gripper. The spooling mechanism may comprise a wireform. A detachable pivot joint may be provided between the cord winder mechanism and the gripper assembly that defines a second axis of rotation.

21 Claims, 15 Drawing Sheets

(56) References Cited

U.S. PATENT DOCUMENTS 1,237,730 A * 8/1917 Weber ..... 242/405.3
1,249,536 A * 12/1917 Sorensen ..... 242/405.3
1,252,483 A * 1/1918 Pattison ..... 242/577.3
1,262,446 A * 4/1918 Caron ..... 242/577.4
1,310,816 A * 7/1919 Weiss ..... 242/404.2
1,347,697 A * 7/1920 Harbaugh ..... 242/577
1,444,154 A * 2/1923 Jenks ..... 242/407.1
1,504,417 A * 8/1924 Beavers ..... 242/574.4
1,543,122 A * 6/1925 Ravenscroft ..... 242/397.2
1,572,151 A * 2/1926 Knatvold ..... 242/405.3
1,674,709 A * 6/1928 Thomas ..... 242/407.1
1,696,056 A * 12/1928 Proctor ..... 242/396.1
1,728,106 A * 9/1929 Collins ..... 242/577
1,823,165 A * 9/1931 Proctor ..... 242/395.1
1,826,481 A * 10/1931 Root ..... 242/405.3
1,827,855 A * 10/1931 Parker ..... 242/574.4
2,047,705 A * 7/1936 Porter ..... 242/396.9
2,165,021 A * 7/1939 Zink ..... 242/405.2
2,172,907 A * 9/1939 Humphrey ..... 242/396.3
2,176,286 A * 10/1939 Zambarano ..... B65H 49/30
242/404.2
2,191,701 A * 2/1940 Wood ..... A47B 57/42
248/243
2,249,433 A * 7/1941 Palmer ..... 242/396.1
2,267,016 A * 12/1941 Harrison ..... 242/396.1
2,424,429 A * 7/1947 Bamberg ..... B60P 7/13
410/116
2,441,883 A * 5/1948 Johnson ..... 242/577.4
2,461,979 A * 2/1949 Hancock ..... 242/395
2,481,753 A * 9/1949 Johnson ..... 242/395
2,486,448 A * 11/1949 Traxler ..... 248/117.1
2,504,550 A * 4/1950 Letzkus ..... 242/396.8
2,510,394 A * 6/1950 Fong ..... A01K 97/16
242/404.2
2,537,519 A * 1/1951 Eastman ..... 242/404.3
2,576,587 A * 11/1951 Furbush ..... 242/395
3,045,961 A * 7/1962 Cygan ..... A47F 5/0846
248/220.42
3,168,260 A * 2/1965 Kittelson ..... 242/532.4
3,169,723 A * 2/1965 Wilson ..... 242/396.8
3,373,953 A * 3/1968 Grove ..... 242/580
3,409,260 A * 11/1968 Bleed ..... A47F 5/0823
248/220.22
3,446,456 A * 5/1969 Wyle ..... 242/129
3,627,222 A * 12/1971 Quenot ..... 242/394.1
3,813,055 A * 5/1974 Pickrell ..... 242/396.9
3,815,837 A * 6/1974 Guthrie ..... 242/550
3,906,777 A * 9/1975 Dickens ..... 72/447
3,931,941 A * 1/1976 Hornbuckle ..... 242/576.1
4,091,559 A * 5/1978 Easley ..... 43/57.3
D251,656 S * 4/1979 McClure ..... D8/359
4,192,473 A * 3/1980 Wellman ..... 242/391
4,277,035 A * 7/1981 Gaski ..... 242/404.3
4,437,625 A * 3/1984 VanSickle ..... 242/129
4,467,925 A * 8/1984 Ratzloff ..... B25H 3/04
211/103
4,506,853 A * 3/1985 Cathey ..... 248/79
4,768,732 A * 9/1988 Greenleaf ..... 242/557
5,025,999 A * 6/1991 Littrell ..... 242/577
5,145,122 A * 9/1992 Poister ..... 242/388.1
5,205,509 A * 4/1993 Noggle ..... 242/406
5,244,165 A * 9/1993 Valentine et al. ..... 242/244
5,279,468 A * 1/1994 Kuster ..... 242/398
5,370,326 A * 12/1994 Webb ..... 242/486.9
5,435,450 A * 7/1995 Delcambre ..... 213/100 R
5,666,992 A * 9/1997 Robins ..... 137/355.23
5,732,733 A * 3/1998 Negus et al. ..... 137/355.27
5,979,816 A * 11/1999 Blankenship et al. ..... 242/400.1
5,988,559 A * 11/1999 Gnass ..... 242/537
6,158,686 A * 12/2000 Lawrence ..... 242/405.2
6,206,317 B1 * 3/2001 Harvestine ..... 242/395
6,267,319 B1 * 7/2001 Hoffmann et al. ..... 242/532.6
6,434,249 B1 * 8/2002 Wei ..... 381/370
6,527,213 B2 * 3/2003 Philippe et al. ..... 242/127
6,561,450 B1 * 5/2003 Walsh ..... 242/395
6,634,592 B1 * 10/2003 Berousek ..... 242/594.3
6,655,627 B2 * 12/2003 Patton ..... 242/397.2
6,951,345 B2 * 10/2005 Wilks ..... 280/477
6,964,085 B2 * 11/2005 Boda ..... A47B 57/54
24/489
7,004,785 B2 * 2/2006 Melton et al. ..... 439/501
7,080,802 B2 * 7/2006 Bayer et al. ..... 242/423.1
7,387,212 B2 6/2008 Costa et al.
7,392,911 B2 7/2008 Stitchick et al.
7,455,258 B2 * 11/2008 Proebstle ..... 242/404.3
7,484,701 B2 * 2/2009 Hsieh ..... 248/339
7,527,157 B2 5/2009 Shinn et al.
7,628,406 B1 * 12/2009 Thomas et al. ..... 280/47.19
7,766,270 B2 * 8/2010 Piepgras ..... 242/395
7,806,259 B2 10/2010 Gregory et al.
7,886,800 B2 * 2/2011 Skoczylas ..... 156/577
7,900,781 B2 * 3/2011 Baine et al. ..... 211/59.1
7,942,362 B1 * 5/2011 Rothell ..... 242/401
7,954,651 B2 * 6/2011 Kao ..... B25H 3/04
211/106.01
8,220,758 B2 * 7/2012 Czajor ..... 248/68.1
8,302,923 B2 * 11/2012 Johnston ..... A47F 5/0823
211/57.1
8,371,518 B2 * 2/2013 Factor ..... 242/557
8,523,098 B2 * 9/2013 Detweiler ..... 242/404.3
8,689,719 B1 * 4/2014 Roberts ..... 114/230.23
8,727,262 B2 * 5/2014 Underbrink et al. ..... 242/573
8,746,472 B2 * 6/2014 Thrush ..... F16M 13/02
211/94.01
2001/0035473 A1 * 11/2001 Patton ..... 242/397.2
2009/0095866 A1 * 4/2009 Brescia ..... B60P 7/13
248/313
2009/0134290 A1 * 5/2009 Begic ..... F16M 13/02
248/222.13
2009/0145867 A1 * 6/2009 Apgood, II ..... A47F 5/0846
211/94.01
2009/0152217 A1 6/2009 Gmerek et al.
2009/0152944 A1 * 6/2009 Baine et al. ..... 307/12
2009/0184221 A1 * 7/2009 Sculler ..... F16M 13/02
248/221.11
2010/0213346 A1 * 8/2010 Chen ..... 248/693
2011/0220754 A1 * 9/2011 Merten et al. ..... 242/400.1
2012/0091086 A1 * 4/2012 Gregory et al. ..... 211/86.01
2013/0092781 A1 * 4/2013 Gregory et al. ..... 242/404

* cited by examiner

CORD WINDER AND RAIL STORAGE SYSTEM

This application claims benefit of priority under 35 U.S.C. §119(e) to the filing date of U.S. Provisional Application No. 61/546,721, as filed on Oct. 13, 2011 which is incorporated herein by reference in its entirety.

BACKGROUND

Rail storage systems typically comprise a wall mountable rail, and accessories that connect to the rail. Such systems may be used in a garage or other similar area. The accessories are designed to hold a wide variety of consumer items such as tools, bicycles, sports equipment and other consumer articles.

SUMMARY OF THE INVENTION

In one embodiment a winder accessory comprises a gripper assembly adapted to be releasably attached to a rail. A cord winder mechanism is supported on the gripper and comprises a spooling mechanism for winding a cord. The spool mechanism rotates on a rotating joint relative to the gripper.

The rotating joint may define an axis of rotation of the spooling mechanism where the axis of rotation is disposed substantially horizontally when the gripper assembly is mounted on the rail. The spooling mechanism may comprise a wireform. The spooling mechanism may comprise a handle. The spooling mechanism may comprise a plug holder. The spooling mechanism may comprise two arms spaced from one another about the rotating joint. The spooling mechanism may comprise a pair of cord retainer mechanisms one of the cord retainer mechanisms mounted to each of the arms. The cord retainer mechanisms may comprise substantially U-shaped members secured to the arms such that the open ends of the U-shaped members extend outwardly. The cord retainer mechanisms may comprise a pair of spaced legs that extend away from the support arms. The ends of the legs may be flared outwardly to facilitate the capture of the cord when the spooling mechanism is rotated. The rotating joint may comprise a stud and a sleeve where the sleeve fits over the stud such that the sleeve and stud may rotate relative to one another. A bushing may be located between the stud and the sleeve. The bushing may comprise a slot that extends through the bushing such that the bushing may be compressed between the sleeve and the stud. The bushing may create an interference fit between the sleeve and the stud where friction generated by the interference fit slows the rotation of the sleeve relative to the stud such that the sleeve does not freely rotate relative to the stud. Friction may be added to the rotating joint to prevent the spooling mechanism from freely rotating. A pivot joint may be provided between the cord winder mechanism and the gripper assembly that defines a second axis of rotation. The pivot joint may detach the cord winder mechanism from the gripper. The pivot joint may comprise a stud that is releasably inserted into a sleeve along the second axis of rotation. The stud may comprise a first end and a second end and is arranged such that the first end and the second end may be inserted into the sleeve. The second axis of rotation may be disposed substantially vertically and the axis of rotation may be disposed substantially horizontally.

DETAILED DESCRIPTION OF EMBODIMENTS OF THE INVENTION

Embodiments of the present invention will be described more fully hereinafter with reference to the accompanying drawings, in which embodiments of the invention are shown. This invention may, however, be embodied in many different forms and should not be construed as limited to the embodiments set forth herein. Like references numbers are used to refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

Relative terms such as "below" or "above" or "upper" or "lower" or "horizontal" or "vertical" or "top" or "bottom" or "front" or "rear" may be used herein to describe a relationship of one element, area or region to another element, area or region as illustrated in the figures.

The cord winder accessory 1 of the invention is shown in the figures as configured to be supported on a rail 2. While a specific embodiment of the rail is shown, the cord winder accessory 1 may be used with other rail configurations. Further, while the cord winder accessory 1 is particularly suited to be mounted on a rail system as shown and described herein, the cord winder accessory may be mounted on a mounting structure other than a rail. For example, the cord winder accessory may be fixed to a mounting plate that is mounted directly to a surface such as a wall using fasteners such as screws.

Figure 1:
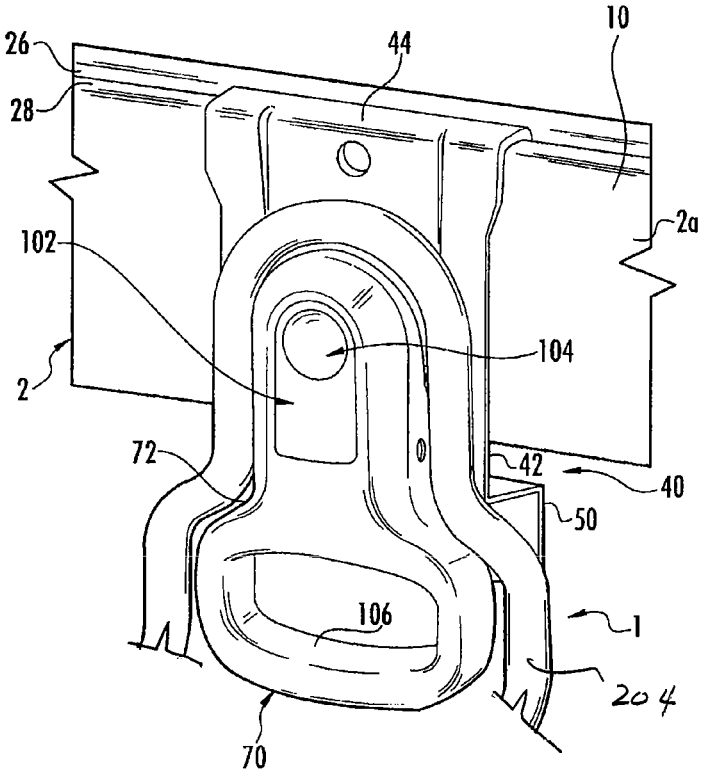
FIG. 1 is a front perspective view of an embodiment of an accessory mounted on a partial rail portion.
Figure 2:
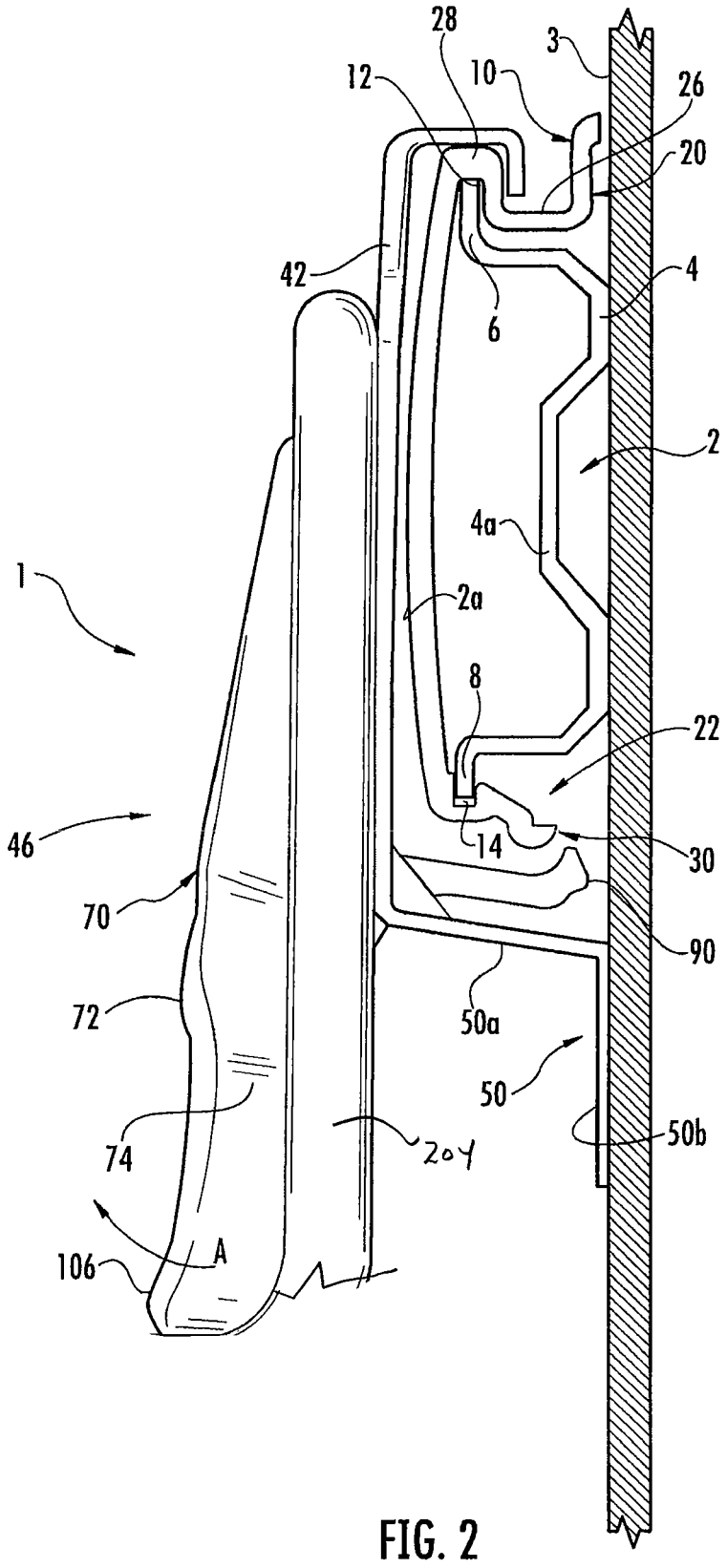
FIG. 2 is a side view of the accessory of FIG. 1 mounted on a rail in the unlocked position.

The cord winder accessory 1 will be described with reference to a rail, an embodiment of which is shown in FIGS. 1 and 2. While a specific embodiment of the rail 2 is shown the accessory of the invention may be used with other rail configurations. Rail 2 extends horizontally along, and is mounted to, a vertical surface 3 such as a wall and may extend for an extended linear distance along the wall. In one embodiment the rail 2 is manufactured and sold in four to seven foot lengths although the rail may have any suitable length. Rail 2 may include a rail member 4 mounted to a wall or other vertical surface 3. The rail member 4 is made of steel or other rigid material and may include apertures for receiving fasteners such as screws for attaching the rail member 4 to the vertical surface 3. The rail member 4 includes a first flange 6 that extends along substantially the entire length of the upper edge of the rail member 4 and a second flange 8 that extends along substantially the entire length of the lower edge of the rail member 4. The flanges 6 and 8 are spaced from the vertical surface 3 when the rail member 4 is attached to vertical surface 3 such that a space is created between the flanges 6, 8 and the vertical surface 3. The rail member 4 may have a center ridge 4*a* formed along the center of the rail to add rigidity to the rail member 4. In the illustrated embodiment the rail member 4 is symmetrical about its longitudinal axis such that such that the rail may be positioned with either of flanges 6 and 8 facing upward and either of flanges 6 and 8 facing downward.

A rail cover 10 is secured to the rail member 4 such that the rail member 4 is disposed behind and covered by the rail cover 10. The rail cover 10 may provide a more decorative finish to the rail and may be made of PVC or other material. The rail cover 10 has a first recess 12 formed along substantially the entire length of the interior of the top edge of rail cover 10. The rail cover 10 also has a second interior recess 14 formed along substantially the entire length of the interior of the bottom edge of rail cover 10. The first recess 12 and second recess 14 are disposed such that they are engaged by flange 6 and flange 8, respectively, to secure the cover 10 to the rail member 4. The cover 10 may be slid over the rail member 4 or the cover 10 may flex to snap onto the rail member 4. Other connection mechanisms may be used to connect the rail cover 10 to the rail member 4 such as separate fasteners. Moreover, the rail may be made of a one-piece member or multiple pieces rather than the two-piece construction shown in the Figures. One such rail system is sold by Newell Rubbermaid, Inc. under the name FAST TRACK®.

The rail cover 10 is formed with an upper engagement mechanism 20 and a lower engagement mechanism 22 for connecting the accessory 1 to the rail 2. The upper engagement mechanism 20 comprises a channel 26 that extends along the length of the upper edge of the rail 2. The channel 26 is defined by a raised edge 28 that extends along the length of the upper edge of the rail cover 10 along the front of channel 26. The lower engagement mechanism 22 comprises a rearwardly extending flange 30 that extends along the length of the lower edge of the rail cover 10 and extends toward the surface 3 and that is engaged by the accessory as will hereinafter be described.

Figure 8:
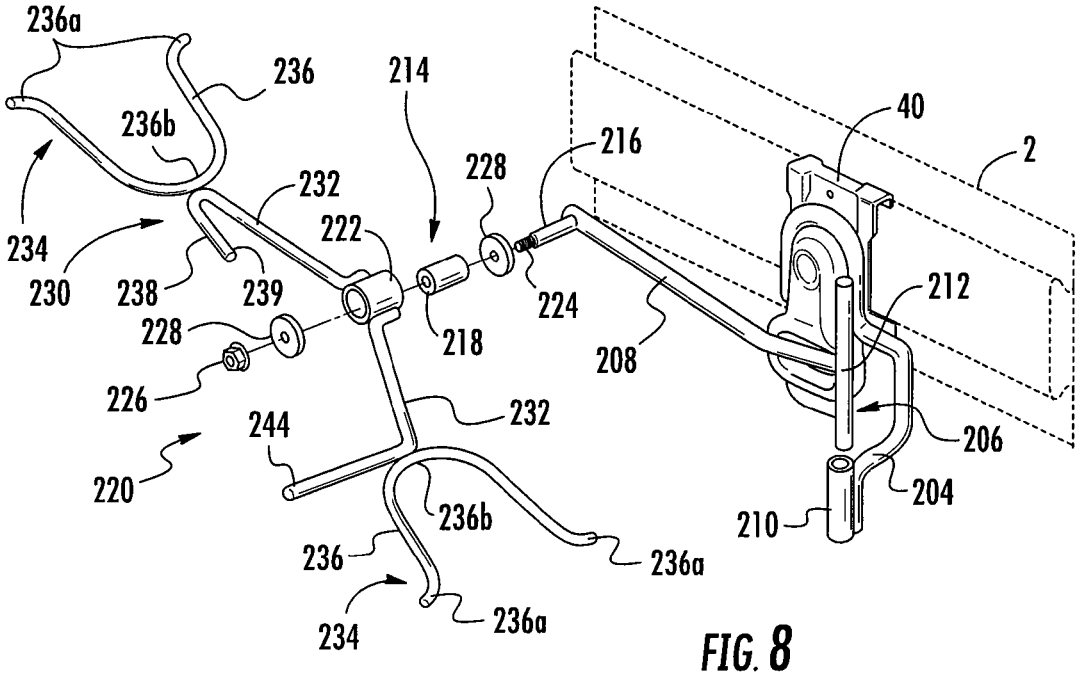
FIG. 8 is an exploded front perspective view of the cord winder accessory of FIG. 7.

Referring to FIGS. 1 through 4, the cord winder accessory 1 comprises a gripper assembly 40 that supports the cord winder mechanism. The gripper assembly 40 comprises a support 42 and a gripper mechanism 70. The cord winder mechanism is attached to the support 42 such as by welding, separate fasteners, a unitary design or the like. The support 42 is in the form of a plate that is dimensioned to extend from the upper edge of rail 2 to beyond the lower edge of rail 2. The support 42 faces the front face 2*a* of rail 2 when the accessory 1 is attached to rail 2. The support 42 has a flange 44 at its upper end that is formed as a downwardly facing hook having a substantially horizontal section 44*a* and a substantially downwardly extending section 44*b* that define a downwardly open channel 48. The flange 44 is dimensioned such that the edge 28 of rail 2 can extend into channel 48 with the downwardly extending flange 44*b* extending into channel 26 to suspend the accessory 1 on the rail 2. A support flange 50 extends from the bottom of support 42 and has a first section 50*a* that extends substantially perpendicular to the support 42 and a second section 50*b* that extends substantially parallel to the support 42. Support 42 is dimensioned such that flange 50 is spaced below the lower edge of rail 2. Flange 50 is dimensioned such that the second section 50*b* abuts or lies closely adjacent to the surface 3 on which the rail 2 is mounted when accessory 1 is mounted on rail 2 as shown in FIG. 8. Section 50*b* of flange 50 assists in supporting the accessory on the rail when a load is placed on the storage accessory 41. A load on the storage accessory 41 will tend to rotate the accessory counter-clockwise (as viewed in FIG. 2) such that the bottom of the accessory 1 will tend to rotate toward the support surface 3. The engagement of the flange 50 with the support surface 3 prevents or limits this motion. Flange section 50*b* may be provided with a hole 51 for receiving a fastener to secure the support 42 to the surface 3. The support 42 may be made of sheetmetal such as steel formed as a flat plate and bent to the desired shape such that the support 42, hook 44 and flange 50 are one-piece.

Figure 3:
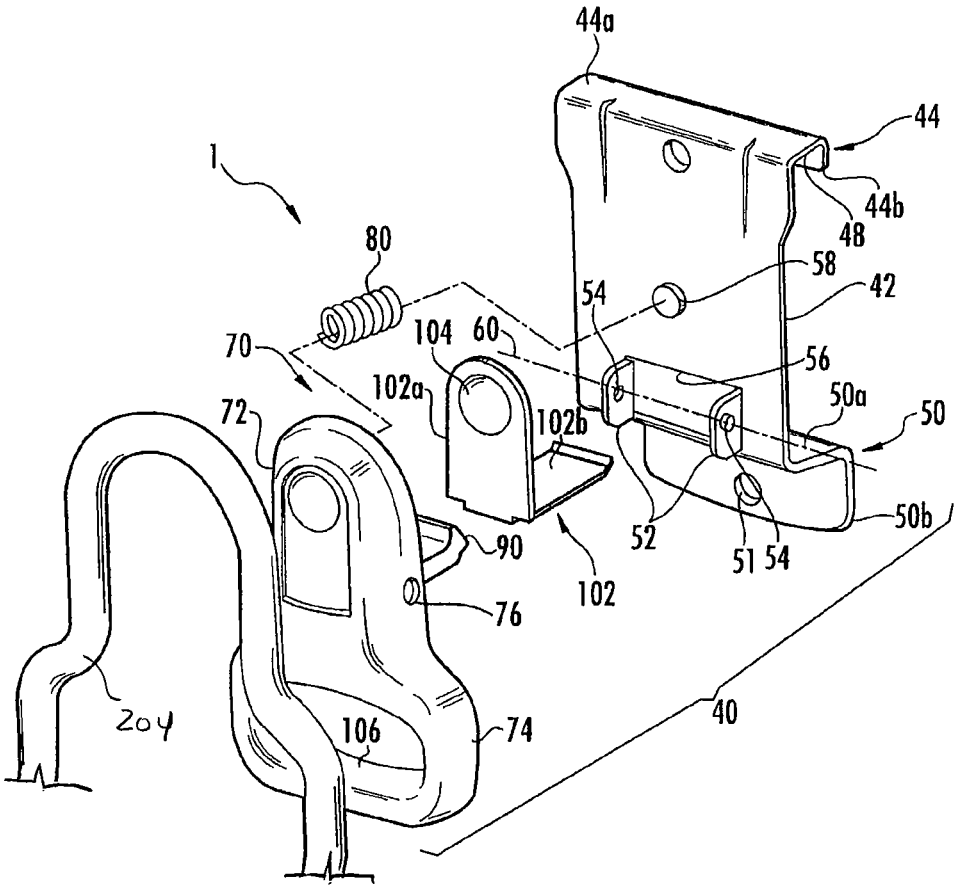
FIG. 3 is an exploded front view of the accessory of FIG. 1.
Figure 4:
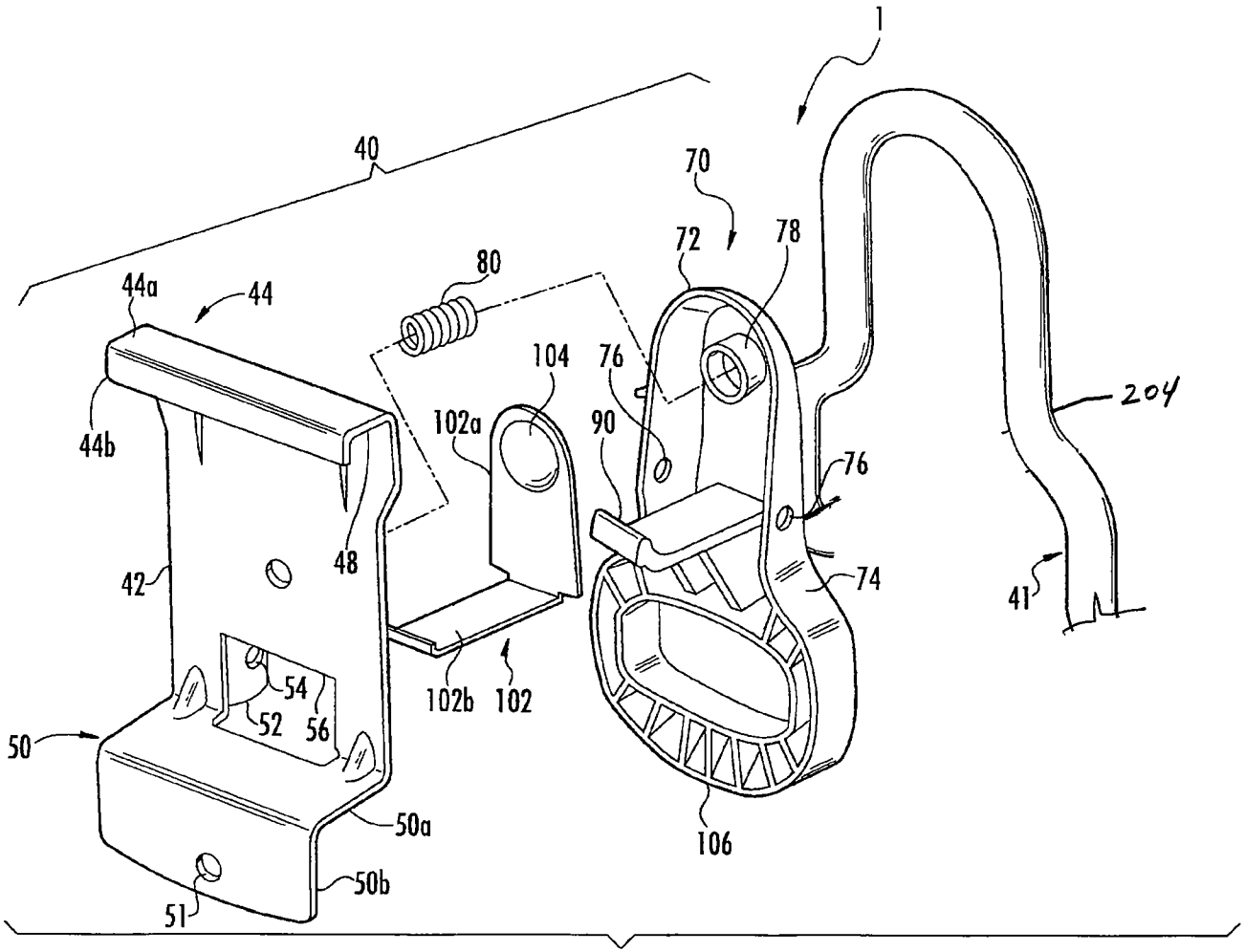
FIG. 4 is an exploded back view of the accessory of FIG. 1.

Referring more specifically to FIGS. 3 and 4, an opening 56 is formed through the support 42 where the opening 56 is disposed opposite to the lower edge of the rail 2 when the accessory 1 is mounted on the rail 2. A pivot axis 60 is formed on the opposite side of the support 42 from flanges 44 and 50 for pivotably supporting the gripper mechanism 70 as will hereinafter be described. In the illustrated embodiment the pivot axis 60 comprises two flanges 52 that extend away from the support 42 where each flange includes a pin 54 that forms the pivot. In the illustrated embodiment, where the support plate is formed of sheetmetal, the flanges 52 may be created by bending the material of the support 42 that was punched out to form opening 56. The pin 54 may be formed as projections pressed or stamped into the flanges 52. The pivot axis may also comprise, for example, a separate pin rotatably mounted to the support 42. A spring perch 58 is also formed on the support 42 on the same side as pivot axis 60. The spring perch 58 may be formed as a protrusion pressed or stamped into the sheetmetal support 42 that engages and supports one end of a compression spring 80.

The gripper assembly 40 also comprises gripper mechanism 70 that comprises a rigid body 72 having a peripheral side wall 74. The body 72 may be formed of molded plastic. A pair of opposed holes or indentations 76 are formed in the side wall 74. The pivot pins 54 on support 42 engage the holes 76 such that the pins 54 can rotate in the holes 76 and the gripper body 72 can pivot about the pivot axis 60 relative to the support 42. A spring perch 78 is formed in the gripper body 72 that is located opposite to and faces the spring perch 58 on the support 42 for receiving the end of the spring 80. Compression spring 80 is supported on the spring perches 58, 78 and is disposed between the gripper mechanism 70 and the support 42 such that the spring 80 biases the gripper body 72 about the pivot axis 60 such that the bottom of the gripper mechanism 70 is pivoted toward support 42 and the rail 2.

Figure 5:
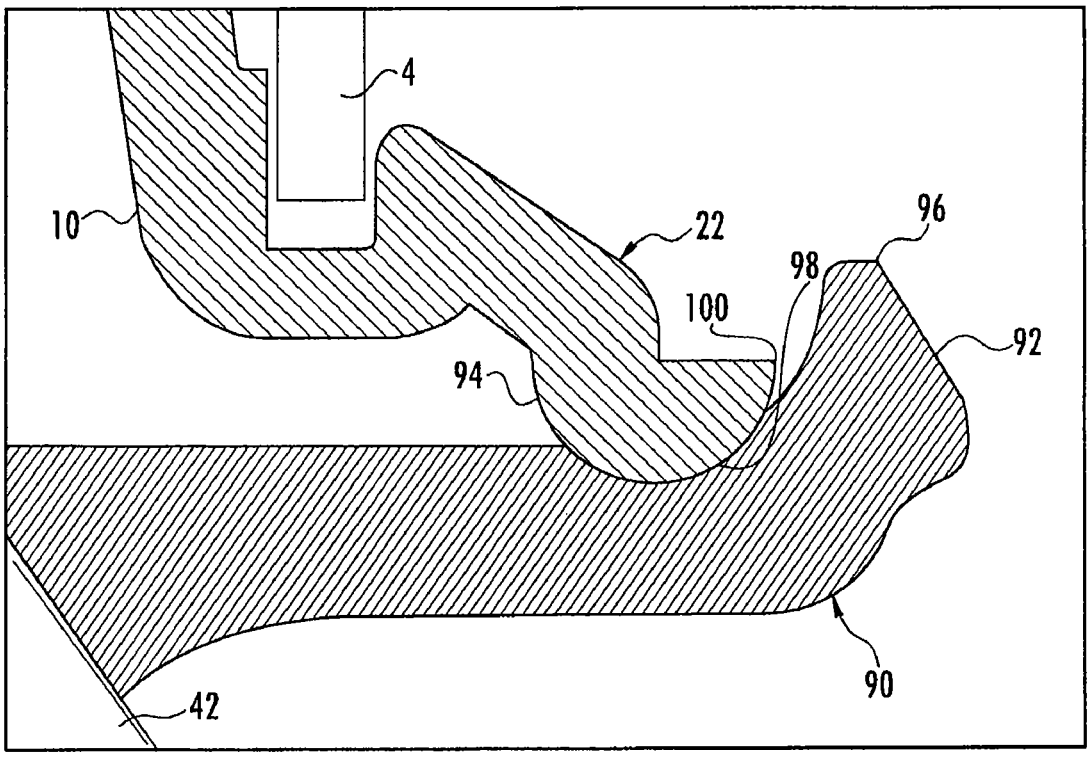
FIG. 5 is a detailed view of the engagement of the latch with a rail in a locked position.

A latch 90 extends from the back side of the gripper body 72 that faces support 42 such that it extends through the hole 56 formed in the support plate 42. The latch 90 is dimensioned and arranged such that the latch 90 is positioned opposite to the lower engagement mechanism 22 when the accessory 1 is mounted on the rail 2. The latch 90 is positioned such that when the top flange 44 is hooked over the edge 28 of the rail 2 the latch 90 is disposed opposite to the lower engagement mechanism 22. Latch 90 includes a cam surface 92 where the cam surface 92 is disposed opposite to and strikes the facing cam surface 94 on the engagement mechanism 22, FIG. 5, during mounting of the accessory 1 on rail 2. The engagement of the cam surface 92 with cam surface 94 rotates the latch 90 and body 72 relative to support 42 away from the rail 2 such that the latch 90 passes under the rail 2 and engagement mechanism 22. When the distal end 96 of the latch 90 clears the bottom of the rail 2, the latch 90 and body 72 rotate relative to the support 42 by spring 80 such that the latch 90 is biased into engagement with the engagement mechanism 22 of the rail 2 to the locked position of FIGS. 5 and 8. The latch 90 is formed with a shaped mating surface 98 that engages and grips a shaped mating surface 100 formed on engagement mechanism 22 to securely lock the accessory 1 to the rail 2. In the illustrated embodiment the mating surface 98 of latch 90 includes a recess that receives a mating protrusion on the engagement mechanism 22 although this structure may be reversed.

Referring to FIGS. 1, 3 and 4, the gripper mechanism 70 may use a reinforcement member 102 to support and reinforce the latch 90 to add strength and rigidity to the latch 90. In one embodiment the reinforcement member 102 is an L-shaped steel plate having a having a first leg 102*a* and a second leg 102*b* arranged at an angle to the first leg 102*a*. The first leg 102*a* extends along and is connected to the body 72 and the second leg 102*b* extends along and is connected to the latch 90. In one embodiment the reinforcement member 102 is insert molded in the molded plastic gripper body 72. The reinforcement member 102 may be exposed on the front surface of the gripper body 72 such that the user may press directly on the exposed portion of reinforcement member 102 in the area above the pivot axis 60 as shown in FIG. 1. The reinforcement member 102 may have a depression 104 for identifying this location for the user. The gripper body 72 may also be rotated by the pulling the bottom of the gripper mechanism 70 away from the rail 2. In this regard the gripper body 72 may be provided with a handle 106 that can be gripped by the user. The reinforcement member 102 may be eliminated such that the gripper body and latch 90 are formed as a one piece all plastic member where area 104 is part of the plastic body.

To mount the accessory 1, on the rail 2, the top hook 44 is located over the raised edge 28 of the rail 2 such that the accessory 1 is suspended on the rail 2. In this position the latch 90 is positioned facing the bottom edge of the rail 2. The cam surface 92 of latch 90 may rest against the cam surface 94 of the lower engagement mechanism 22. The user pushes the accessory 1 toward rail 2 to rotate the bottom of the accessory 1 toward rail 4 such that latch 90 moves against the engagement mechanism 22. The cam surface 92 on the latch 90 engages the cam surface 94 on the engagement mechanism 22 such that the body 72 and latch 90 are rotated about axis 60 relative to the support 42 and away from the rail 2 such that the latch 90 is moved generally downward as viewed in the figures. Body 72 rotates about pivot axis 60 such that the latch 90 is rotated under rail 2. As the user continues to push the bottom of accessory 1 toward rail 2, the latch 90 passes under the bottom of the rail 2. Once the end 96 of latch 90 clears the end of engagement mechanism 22 the body and latch are moved relative to support 42 by spring 80 until the mating surface 98 of the latch 90 engages the mating surface 100 of the engagement mechanism 22 to the locked position shown in FIGS. 5 and 8. The engagement of the latch 90 with the rail 2 prevents the accessory 1 from being inadvertently knocked off of the rail by the user even if the user applies an upward force to the accessory 1.

Figure 6:
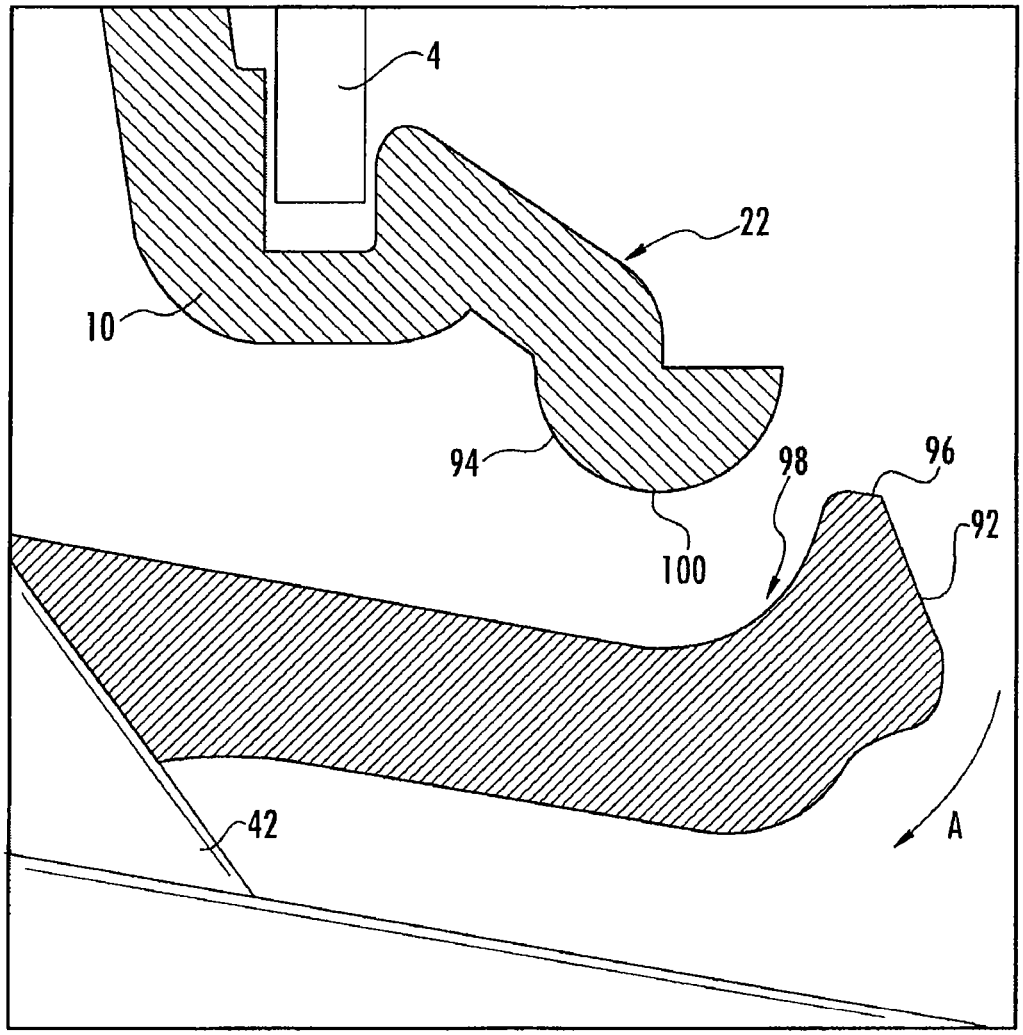
FIG. 6 is a detailed view of the disengagement of the latch from a rail in an unlocked position.

To remove the accessory 1 from the rail 2, the user rotates the gripper body 72 relative to the support 42 to release the latch 90 from the engagement mechanism 22 and move the gripper mechanism 70 to the unlocked position shown in FIGS. 2 and 6. The user may either pull on the bottom of the gripper body 72 at handle 106 or push at area 104 to rotate the bottom of the gripper body 72 and latch 90 away from the rail 2 as shown by arrow A in FIG. 6. Once the latch 90 is disengaged from the rail 2, the hook 44 can be lifted from the top of the rail 2 and the accessory 1 removed from the rail.

The cord winder accessory 1 can be positioned and repositioned anywhere along the rail 2. One suitable system with which the cord winder accessory 1 may be used is described in U.S. Pat. No. 7,900,781, titled "Storage System", which is incorporated herein by reference in its entirety. Another suitable system with which the cord winder accessory 1 may be used is described in U.S. Patent Application Publication No. US 2012/0091086, titled "Rail Storage System", which is incorporated herein by reference in its entirety. Other arrangements and configurations of the rail and gripper may be used to support the cord winder accessory 1.

Referring to the Figures, embodiments of a cord winder accessory is shown that comprises an accessory mount or gripper, such as gripper assembly 40 described above, that supports the cord winder on a rail. The cord winder accessory 1 comprises a cord winder mechanism 200 that is connected to the gripper assembly 40 such that the cord winder mechanism 200 is securely supported by the gripper. The cord winder accessory 1 may be used for winding cords such as electrical cords, extension cords, rope, hose or other flexible elongated members (referred to collectively herein as "cord"). The cord winder accessory of the invention eliminates twisting of the cord or other member by using a rotary wrapping design. To free the user's hands for winding the cord, the winder may be constrained from movement by attaching the cord winder accessory to a storage rail using a gripper such as used in the Rubbermaid Fasttrack® storage system and as described previously herein. Once the cord winder accessory is fixed in position such as by being locked onto a rail using the gripper assembly 40 both of the users' hands are free to wind the cord. One hand may be used to drive a crank and the other hand may be used to guide the cord onto the rotating spooling mechanism 220 and keep appropriate tension in the cord to prevent unraveling and/or binding of the cord. Also, the spooling mechanism 220 has a suitably sized radial length to improve the efficiency and speed of winding over other rotary cord winder units. In some embodiments, the cord winder accessory 1 may comprise a detachable pivot hinge that is separate from the gripper and that allows the user to reposition the cord winder relative to the wall. In some embodiments, the spooling mechanism 220 may be moved between a left and right first positions parallel to the wall to optimize storage space (shown in FIG. 7) and a second position where it extends from the wall (shown in FIG. 9).

Figure 7:
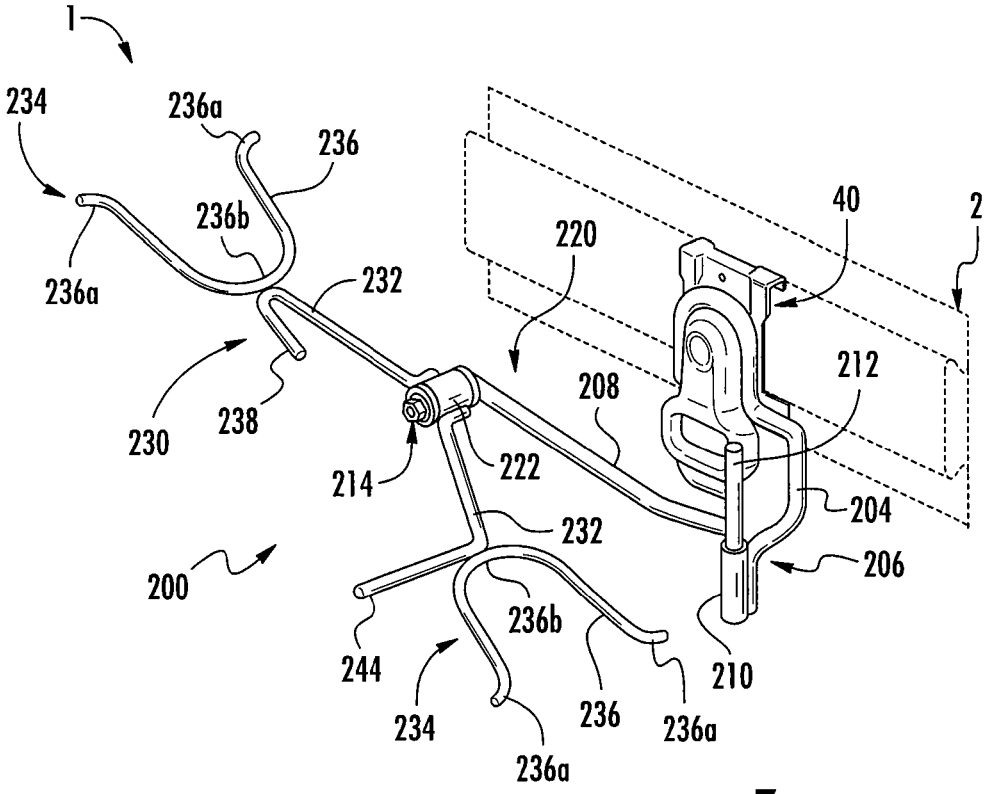
FIG. 7 is a front perspective view of an embodiment of a cord winder accessory mounted on a rail.

Referring to FIGS. 7 and 8, in one embodiment, the winder accessory 1 comprises a support 204 that supports the winder mechanism 200 on the gripper assembly 40. The support 204 may comprise a wire form bent to engage and be secured to the gripper assembly 40. The support 204 may be secured to the gripper assembly 40 by welding, separate fasteners, adhesive, friction fit, mechanical engagement or the like or a combination of such mechanisms. The support 204 may be permanently attached to the gripper mechanism 70 or it may be removably mounted to the gripper mechanism 70. In some embodiments, the free end of the support 204 pivotably supports the winder mechanism 200 at a pivot joint 206 such that the winder mechanism 200 may rotate relative to the support 204 about a vertical axis. The winder mechanism 200 comprises a winder body 208 that may be pivoted about the pivot joint 206 such that it may be rotated flat against the wall in left or right first positions or extended away from the wall in a second position. The pivot joint 206 may provide a separable connection between the winder mechanism 200 and the support 204 such that the winder mechanism 200 may be removed from the gripper assembly 40. Because the winder mechanism 200 is removable, a user may remove the winder mechanism 200 and use the winder mechanism 200 remote from the gripper assembly 40 and rail 2. In one embodiment, the pivot joint 206 comprises a vertically oriented cylindrical sleeve 210 secured to the support 204 that rotatably receives a post or stud 212 formed on one end of the winder body 208. The cylindrical post or stud 212 may be removably inserted into the mating cylindrical sleeve 210 such that the winder body 208 may be removed from the gripper mechanism 70 simply by lifting the stud 212 from the sleeve 210. A suitable low friction bushing such as a low friction plastic tubular sleeve may be provided between the stud 212 and the sleeve 210.

In one embodiment, the winder body 208 is attached to a central portion of the stud 212 such that when the stud 212 is removed from the sleeve 210, the stud 212 forms a convenient hand grip that may be held by the user for carrying the winder. By centering the body 208 on the stud 212 the weight of the winder mechanism be centered in the user's hand when it is carried. Moreover, centering the body 208 on the stud 212 allows the winder mechanism 200 to be easily carried by both right handed and left handed people. Further, the entire winder mechanism 200 may be turned upside down 180 degrees such that the top end of the stud 212 (as viewed in FIG. 7) is inserted into sleeve 210. By flipping over the winder mechanism 200, the winder may be pivoted to the right side of the pivot joint 206 (rather to the left side of the pivot joint 206 as shown) so as to be positioned parallel to the rail 2 to either the right or left side of pivot joint 206.

The body 208 may also comprise a wire form that has a first end fixed to the stud 212 and a second end that supports a rotating joint 214. The rotating joint 214 has an axis of rotation that is disposed substantially horizontally when the winder mechanism 200 is attached to the gripper assembly 40 at pivot joint 206. In one embodiment, the rotating joint 214 is arranged such that the axis of rotation extends perpendicularly to the rail 2 when the body 208 is rotated to the first position adjacent rail 2. In one embodiment, the rotating joint 214 comprises a stud 216 that is supported by and fixed to the body 208. The stud 216 supports a bushing 218 such as a plastic bushing that rides on the stud 216 to provide a low friction mount for the spooling mechanism 220. The spooling mechanism 220 comprises a bearing sleeve 222 that fits over and rotates on the bushing 218 such that the spooling mechanism 220 may rotate about the stud 212. The stud 212 may be provided with screw threads 224 at its distal end. A nut 226 may engage the threads 224 to secure the spooling mechanism 220 on the stud 216. A pair of low friction washers 228 such as plastic washers may be provided on each end of the sleeve 222 (between the sleeve 222 and the nut 226 and between the sleeve 222 and the body 208) to provide low friction surfaces against which the bearing sleeve 222 rotates. While a particular embodiment of the rotating joint 214 is shown, numerous changes may be made in the details of the rotating joint 14.

The spooling mechanism 220 comprises a support structure 230 for supporting a cord retainer structure 234 on the bearing sleeve 222. In one embodiment the support structure 230 comprises a pair of arms 232 that are fixed to and extend from the bearing sleeve 222. The arms 232 may be located 180 degrees from one another such that the spooling mechanism 220 is relatively evenly balanced on the bearing sleeve 222. While two arms 232 are shown, the support structure 230 may comprise a greater number of arms. Each arm 232 supports a cord retainer structure 234. In one embodiment the cord retainer structure 234 comprises a U-shaped member 236 attached to the distal ends of each of the arms 232. The U-shaped members 236 are arranged such that the troughs **236*b* of the U-shaped members 236 are attached to the arms 232 with the spaced legs 236*b* extending away from the support arms 232. The ends of the legs 236*b* are flared outwardly to facilitate the capture of the cord in the U-shaped members 236 when the spooling mechanism 220 is rotated. A cord may be wound between the cord retainer structures 234 such that the cord extends between and is wrapped around the retainer structures. While the cord retainer structures 234 are shown as U-shaped members the cord retainer structures may have other than a U-shape provided a cord may be inserted into the retainer members as the spooling mechanism 220** is rotated. For example, the cord retainer structure may comprise a rotating drum or spool.

One of the arms 232 may comprise a handle or crank 244 to facilitate the rotation of the spooling mechanism 220 on the rotating joint 214. In one embodiment the handle or crank 244 is formed as an extension of one of the arms 232 such that the handle is disposed parallel to the axis of rotation of the pivot joint 206. The other arm 232 may be formed with a plug holder 238 that retains the end of an electrical cord having a plug. The plug holder 238 comprises a hook or other similar structure into which the end of the cord with the plug may be inserted through opening 239.

As shown in the various embodiments described herein, the support 204, body 208, support structure 234, cord retainer structures 234, plug holder 238 and handle 244 may be made of bent wireforms. The structures may be assembled from multiple wireforms secured together such as by welding or the like. Further, a single one-piece wireform may be used to make multiple structures. The wireforms may be assembled to create the various components and structures defined herein in a wide variety of ways.

Figure 9:
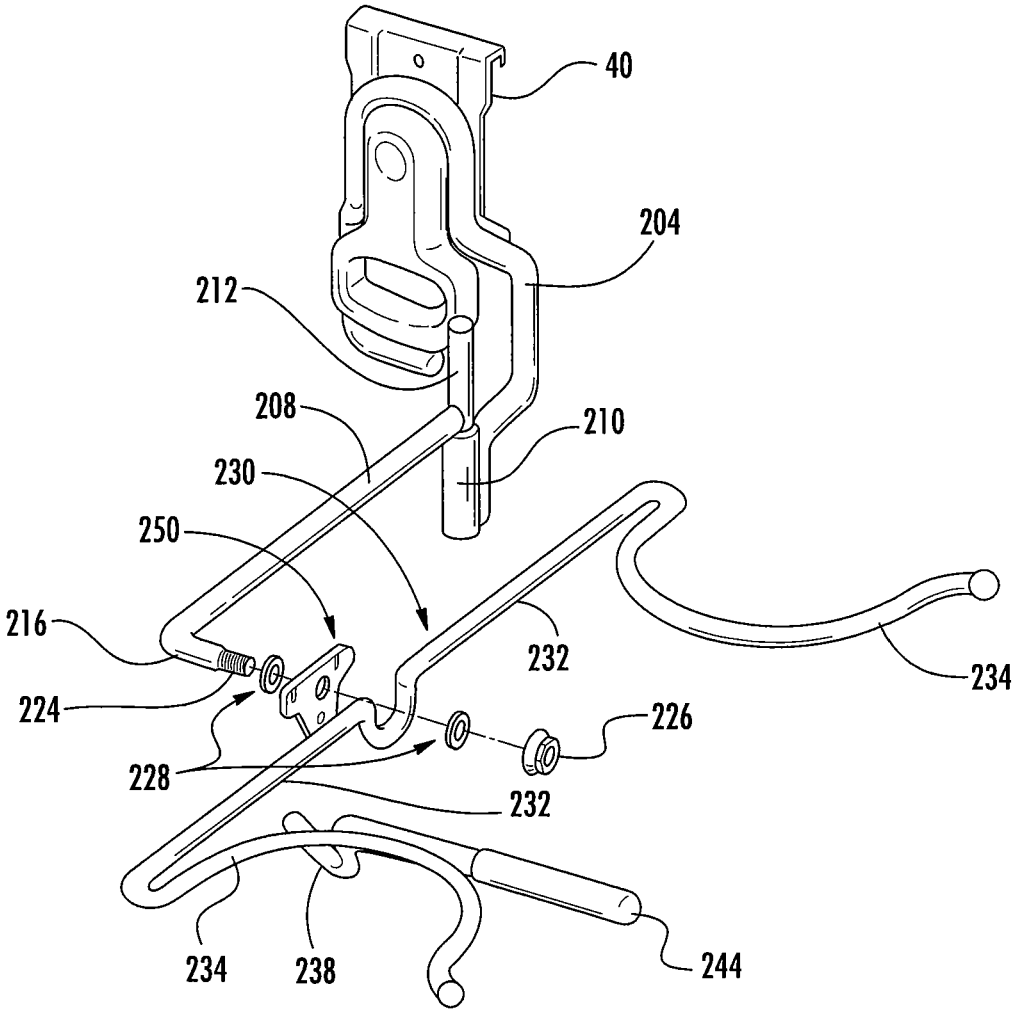
FIG. 9 is an exploded front perspective view of another embodiment of the cord winder accessory of the invention.
Figure 10:
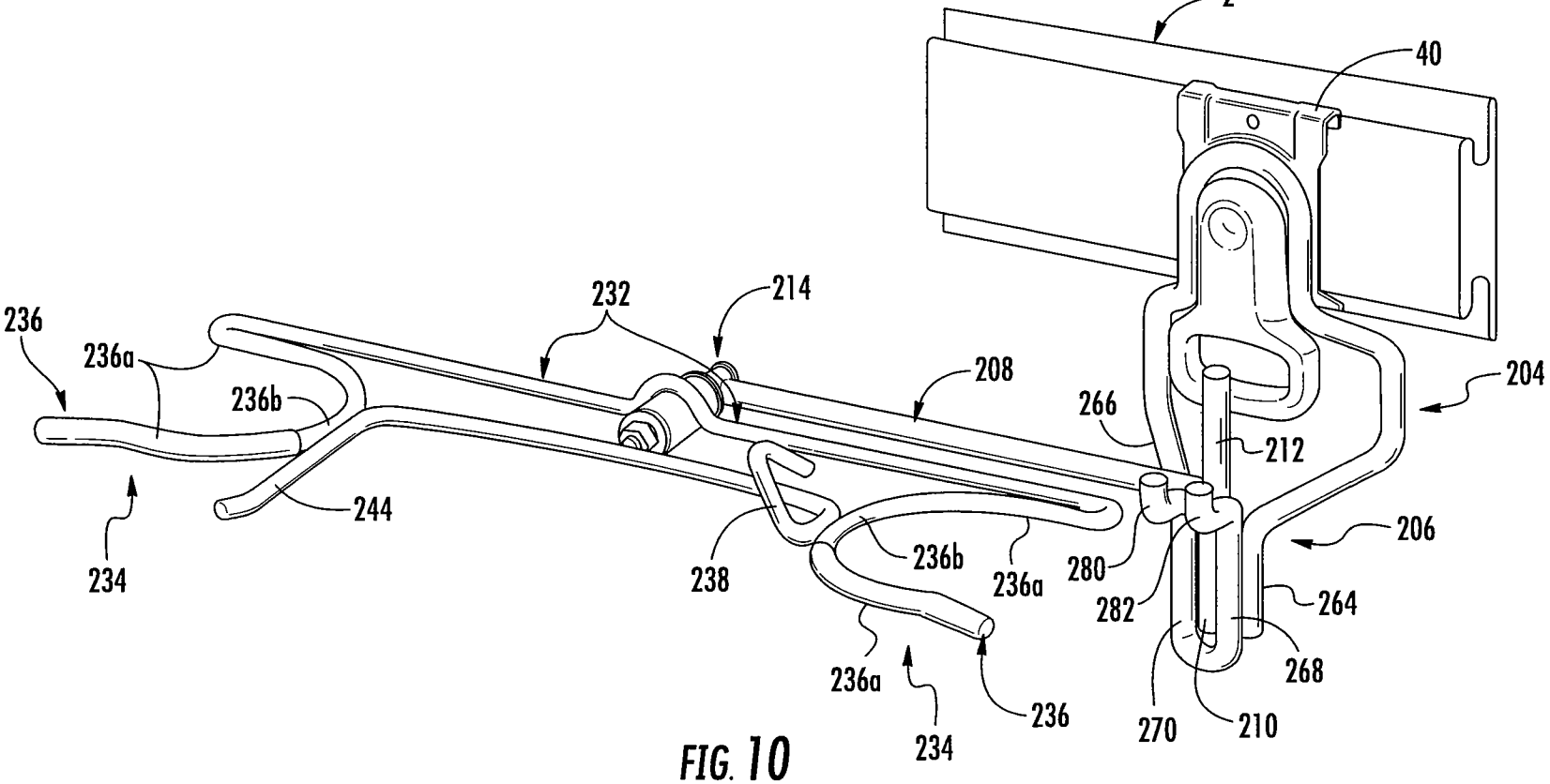
FIG. 10 is a front perspective view of a yet another embodiment of a cord winder accessory mounted on a rail.
Figure 11:
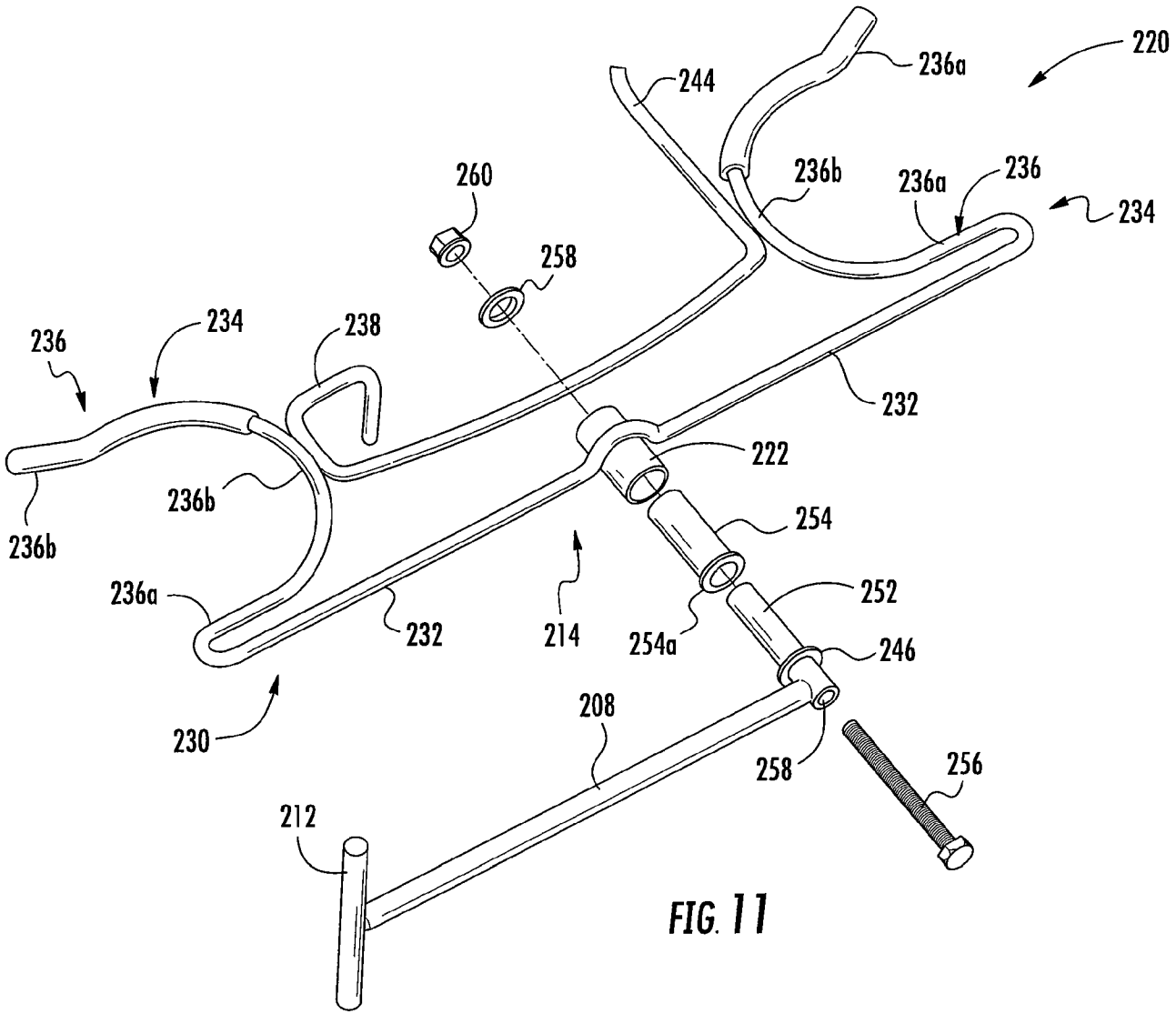
FIG. 11 is an exploded front perspective view of the cord winder accessory of FIG. 10.
Figure 12:
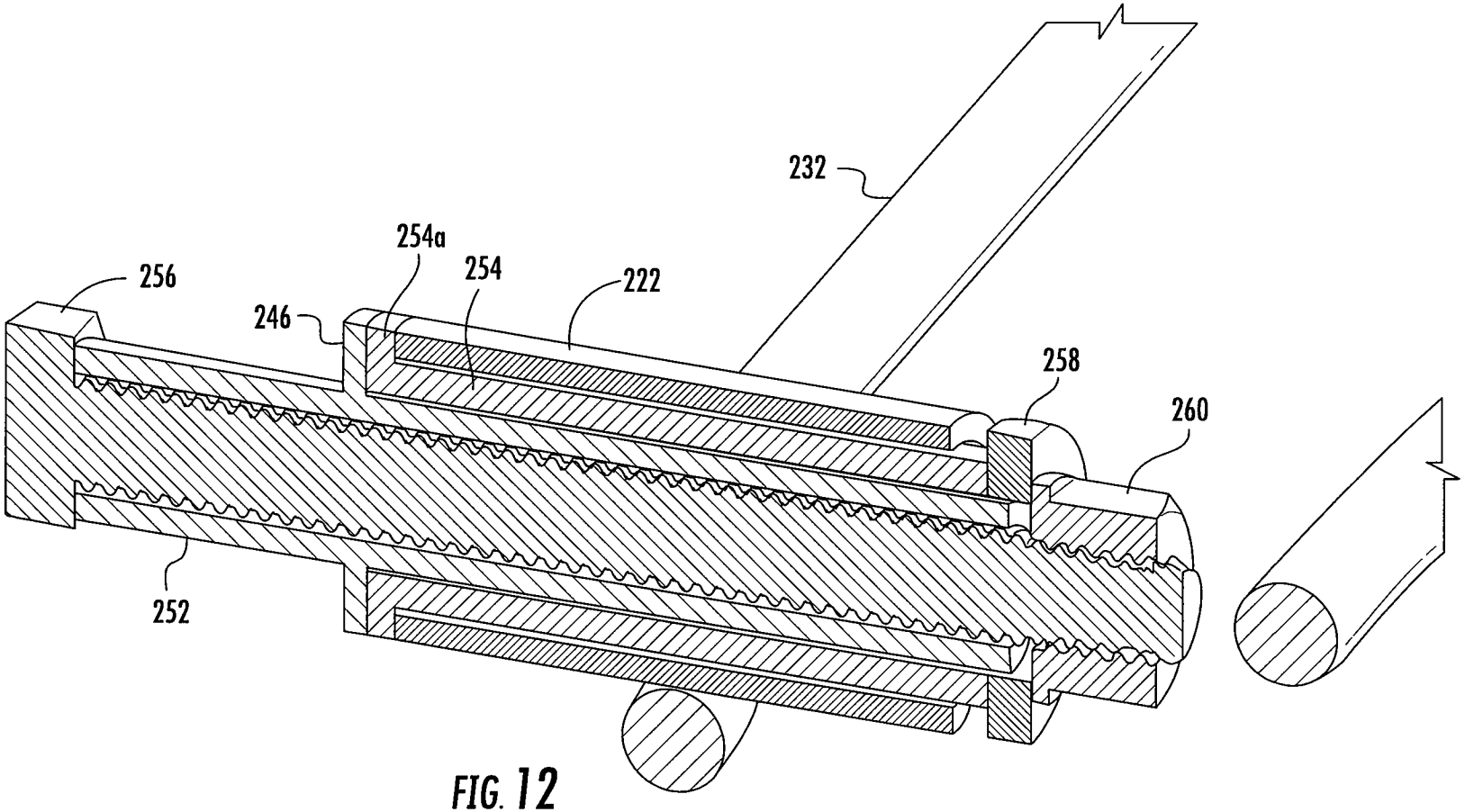
FIG. 12 is a partial section view of the cord winder accessory of FIG. 10.

For example, in some embodiments, the support structure 230 and the cord retainer structures 234 may be formed of one-piece such as a wireform bent into, or otherwise made, into the shape shown in FIG. 9. In the embodiment of FIG. 9, the handle or crank 244 is attached as a separate component to the one-piece support structure 230 and cord retainer structures 234 rather than being formed as part of the support structure. The plug holder 238 may also formed as part of the wireform that forms the handle or crank 244. In some embodiments, the cylindrical bearing sleeve of FIGS. 7 and 8 may be replaced by a bearing plate 250 as shown in FIG. 9 where the bearing plate 50 is fixed to the support structure 230 and rotates on the stud 216.

Another embodiment of the invention is shown in FIGS. 10 through 14. The threaded stud 216 is replaced by a non-threaded bearing sleeve 252. The sleeve 252 supports a plastic or other low friction bushing 254 on its outer surface and receives a threaded member 256, such as a bolt, in the cylindrical bore 258. A nut 260 engages the bolt 256 to retain the bolt 256 in the bearing sleeve 252 and to secure the spooling mechanism 220 on the bearing sleeve 252. In the embodiment of FIGS. 10 through 14, the low friction bushing 254 is formed with an integral washer 254*a* such that only a single separate washer 258 is used, disposed between the bearing sleeve 222 and the nut 260. A retaining flange 246, formed on the sleeve 252, acts as a seat against which the bushing 254 and sleeve 222 are trapped when the nut 260 is tightened on bolt 256. The handle 244 and the plug holder 238 are formed of a single wireform that extends between the cord retainer structures 234. In addition to forming the plug holder 238 and handle 244 this member reinforces the spooling structure.

An alternate embodiment of the pivot hinge 206 is used in the embodiment shown in FIGS. 10 through 14. The support 204 supports a vertically disposed sleeve 210 that is dimensioned to receive the stud 212 formed on the end of the winder body 208. The sleeve 210 is supported by rear wireforms 264 and 266 that are connected to the gripper assembly 40. Front wireforms 268 and 270 are attached to the sleeve 210 and may be made by a separate wireform structure. The sleeve 210 and wireforms 264, 266, 268 and 270 define three discrete positions 272, 274 and 276 for retaining the winder mechanism 200 in a retracted left position, a retracted right position and an extended position. In the retracted positions the winder mechanism and body 208 are disposed adjacent and parallel to the rail 2 to either the right or left of the pivot hinge 206 and in the extended position the winder mechanism may extend from the rail 2. When the post 212 is inserted into the sleeve 210 the body 208 is trapped between two adjacent wireforms to hold the winder mechanism 200 in the desired position 272, 274, 276. To move the winder mechanism 200 between the positions, the winder mechanism 200 is lifted such that the body 208 is removed from between the adjacent wire forms and the winder mechanism 200 is then rotated to another one of the discrete positions. When the winder mechanism 200 is positioned in the desired position, the stud 212 is lowered into sleeve 210 such that the body 208 is again trapped between two adjacent wireforms in one of the positions 272, 274, 276. While the discrete positions have been shown and described as being defined by the wireforms attached to sleeve 210, the sleeve 210 may have notches or recesses along its top edge that receive the body 208 and define the discrete positions 272, 274, 276.

Figure 13:
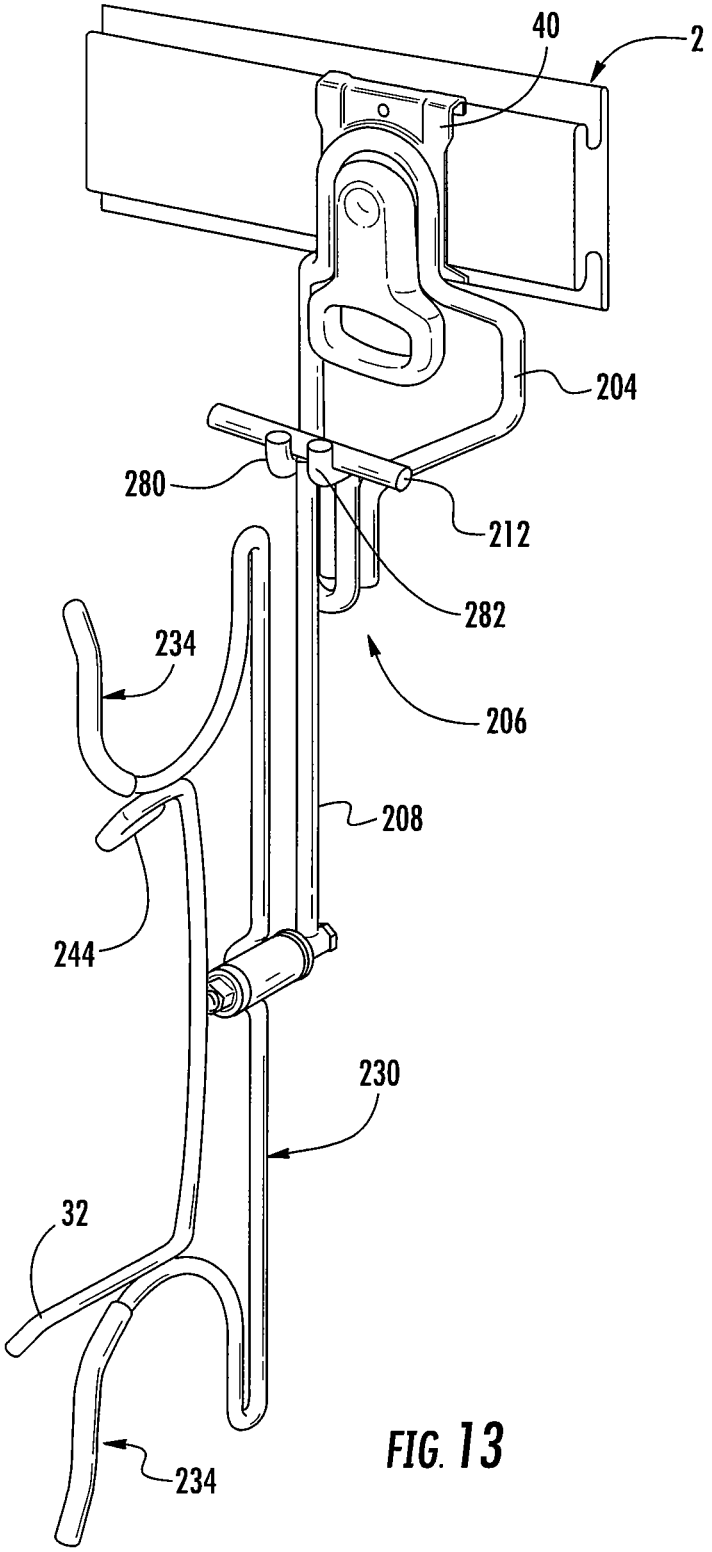
FIG. 13 is a front perspective view of the cord winder accessory of FIG. 10 in a second position.
Figure 14:
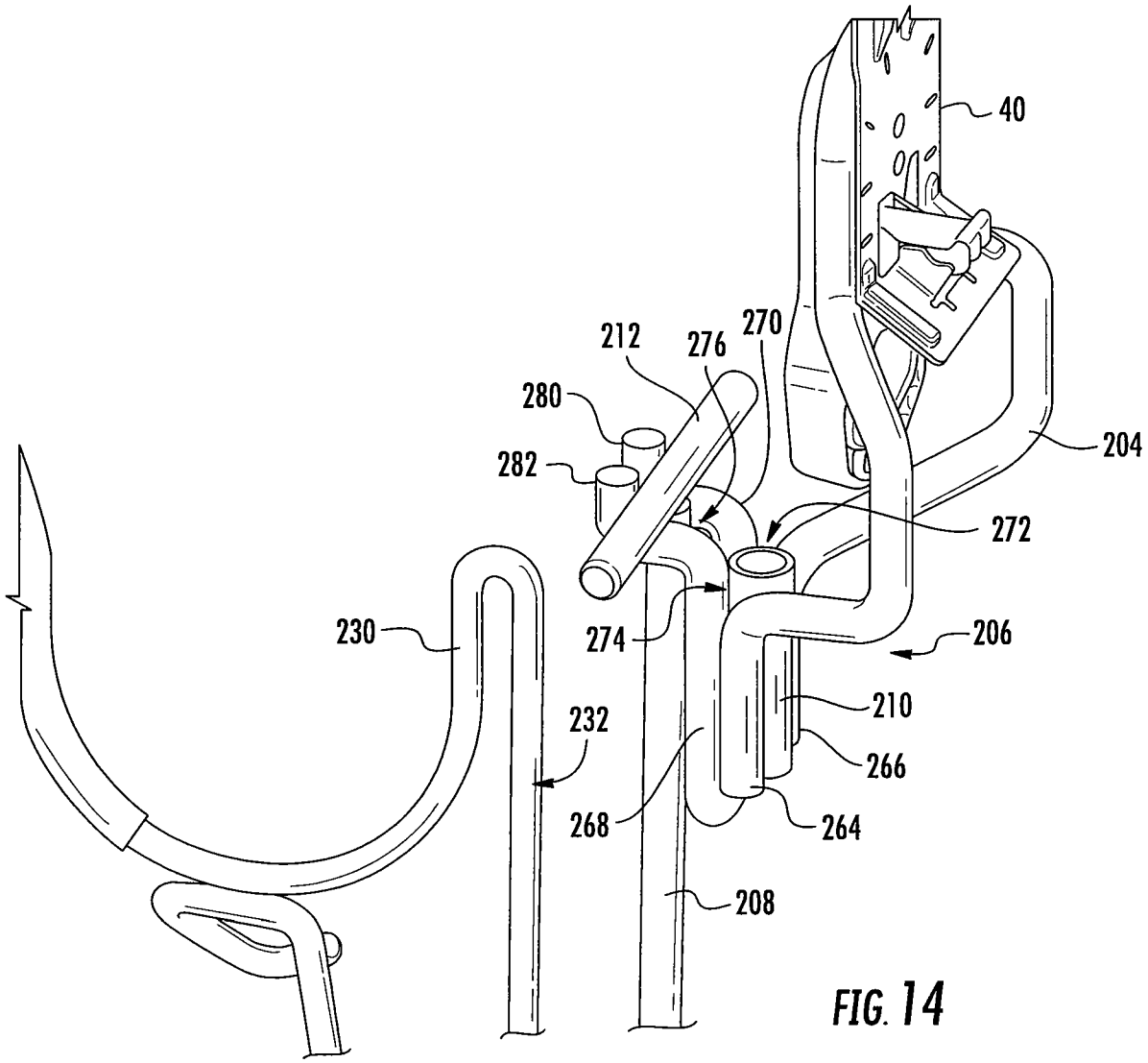
FIG. 14 is a detailed front perspective view of the cord winder accessory of FIG. 10 in the second position.
Figure 15:
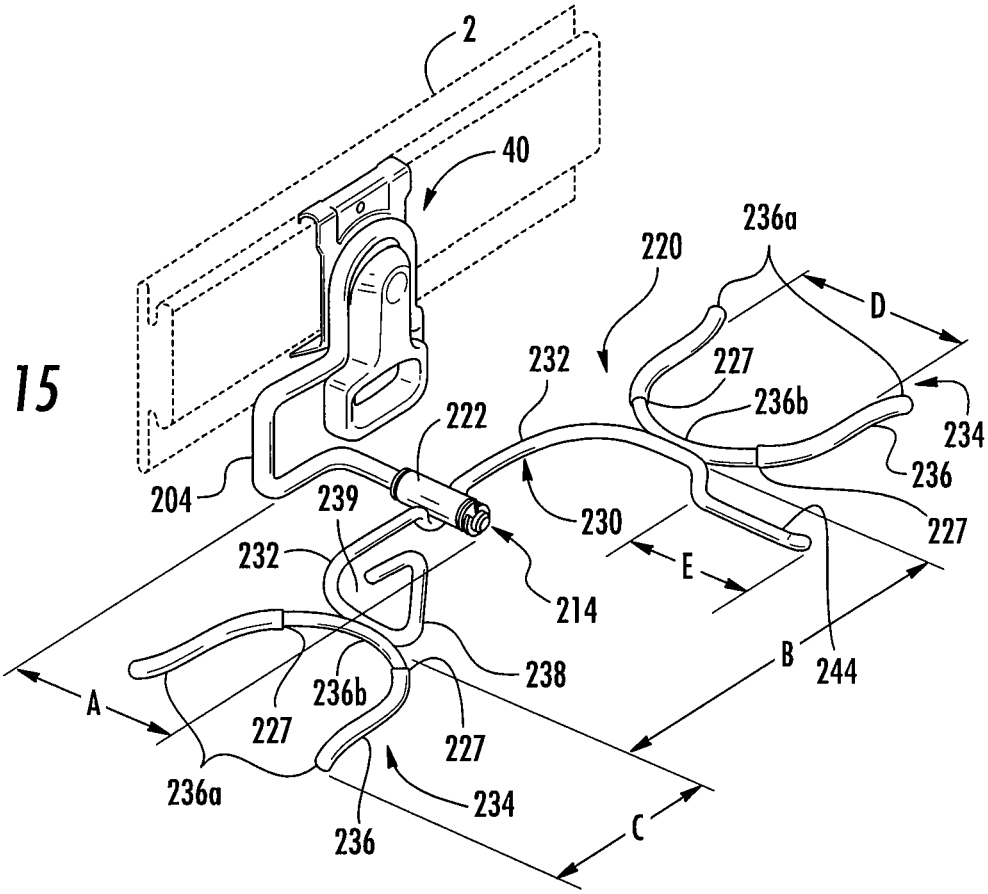
FIG. 15 is a front perspective view of still another embodiment of a cord winder accessory mounted on a rail.

A pair of hooks 280 and 282 project from the front of the sleeve 210 and are spaced from one another to receive the body 208 therebetween. In one embodiment the hooks 280 and 282 are formed by bending the top ends of the front wireforms 268 and 270 with one hook positioned to each side of sleeve 210. The hooks 280 and 282 are arranged such that the winder mechanism 200 may be suspended vertically as shown in FIGS. 13 and 14. In this position the stud 212 is not inserted into sleeve 210. Rather stud 212 spans and is suspended on hooks 280 and 282 such that the body 208 extends downwardly and is suspended between the hooks 280 and 282 and is disposed adjacent and parallel to the wall 3.

While the support 204, body 208 and spooling mechanism 220 in the illustrated embodiments are formed of wireform structures where metal rods (or wireforms) are bent into the desired shape, these components may be made in other ways and using other materials and may have shapes other than the rod shape shown in the drawings. For example, these components may be made of molded or extruded plastic or extruded or die cast metal. Further, the various components may be made as one piece or as multiple pieces connected together as described herein. In a wireform structure as described herein, an epoxy powder coating may be applied to the components.

To use the winder accessory 1, the gripper assembly 40 may be attached to a rail 2. The winder body 208 may be rotated about the axis defined by pivot joint 206 such that it extends substantially perpendicularly from the wall on which the winder is mounted. The user may grasp handle or crank 244 to rotate the spooling mechanism 220 and wind and/or unwind the cord. The cord may also be unwound simply by pulling on the cord. The cord may be wound on the spooling mechanism 220 using handle 244. For storage, the wringer body 208 may be rotated about pivot joint 206 such that the body 208 extends parallel to and closely adjacent the wall for storage. If the user wants to use the cord in a remote location, the stud 212 may be removed from the sleeve 210 and the spooling mechanism 220 may be carried to the desired location. The user may also remove the gripper assembly 40 from the rail 2 to reposition the winder accessory 1 on the rail 2 or to move the winder accessory 1 to another location.

A

An alternate embodiment of the winder accessory is shown in FIGS. 15 through 20 and comprises a gripper assembly 40 for being attached to a rail as previously described. The support 204 comprises a rotating joint 214 that allows the spooling mechanism 220 to rotate relative to support 204 about a substantially horizontal axis to wind or unwind a cord. Unlike the previous embodiments, the winder accessory of FIGS. 15 through 20 does not include a body that pivots about a vertical axis on a detachable pivot joint. As a result, while the winder accessory may be repositioned on a rail using gripper assembly 40 it cannot be moved relative to the rail between retracted and extended positions. Moreover, while the winder accessory 1 may be removed from the rail 2 by removing gripper assembly 40 from the rail 2, there is no separate connection such as at detachable pivot joint 206.

The winder mechanism comprises a spooling mechanism 220 comprising a support structure 230 comprising two arms 232 attached to a central sleeve 222 where the arms 232 are spaced from one another approximately 180 degrees such that the spooling mechanism is approximately evenly balanced. The arms 232 may be formed of a one-piece component that is attached at a midpoint to the sleeve 222. In the illustrated embodiment the arms 232 are formed of a wireform bent to the desired shape. One end of the wireform is bent to form an exposed handle 244 that extends from the spooling mechanism approximately parallel to the axis of rotation. The opposite end of the wireform is bent to form a plug holder 238 in the shape of a hook. The cord may be inserted through opening 239 and the plug may be retained by the plug holder 238 during winding of the cord on the spooling mechanism. The plug holder 238 is dimensioned such that the plug cannot fit through the interior space defined by the hook.

The cord retainer mechanism 234 comprises a pair of substantially U-shaped members 236 secured to the arms 232 such that the open ends of the U-shaped members extend outwardly. The U-shaped members 236 are arranged such that the troughs 236*b* of the U-shaped members 236 are attached to the arms 232 with the spaced legs 236*a* extending away from the support arms 232. The ends of the legs 236*a* are flared outwardly to facilitate the capture of the cord in the U-shaped members 236 when the winder mechanism is rotated. A cord may be wound between the cord retainer structures 234 such that the cord extends between and is wrapped around the retainer structures. While the cord retainer structures 234 are shown as U-shaped members the cord retainer structures may have other than a U-shape provided a cord may be inserted into the retainer members as the spooling mechanism 220 is rotated. For example, the cord retainer structure may comprise a rotting drum or spool. PVC sleeves 227 may be provided over the ends of the legs if desired.

In one preferred embodiment, the stud 224 may have a length A of between approximately 2.5 and 3.5 inches with one preferred length being approximately 3 inches. The support structure 230 may have a length B of between approximately 7.0 and 8.0 inches with one preferred length being approximately 7.5 inches. The U-shaped members may have a depth C of between approximately 3.0 and 4.0 inches with one preferred depth being approximately 3.5 inches, and a width D of between approximately 3.5 and 4.5 inches with one preferred width being approximately 4.0 inches. The handle 244 may have a length E of between approximately 2.0 and 2.0 inches with one preferred length being approximately 2.5 inches.

Figure 16:
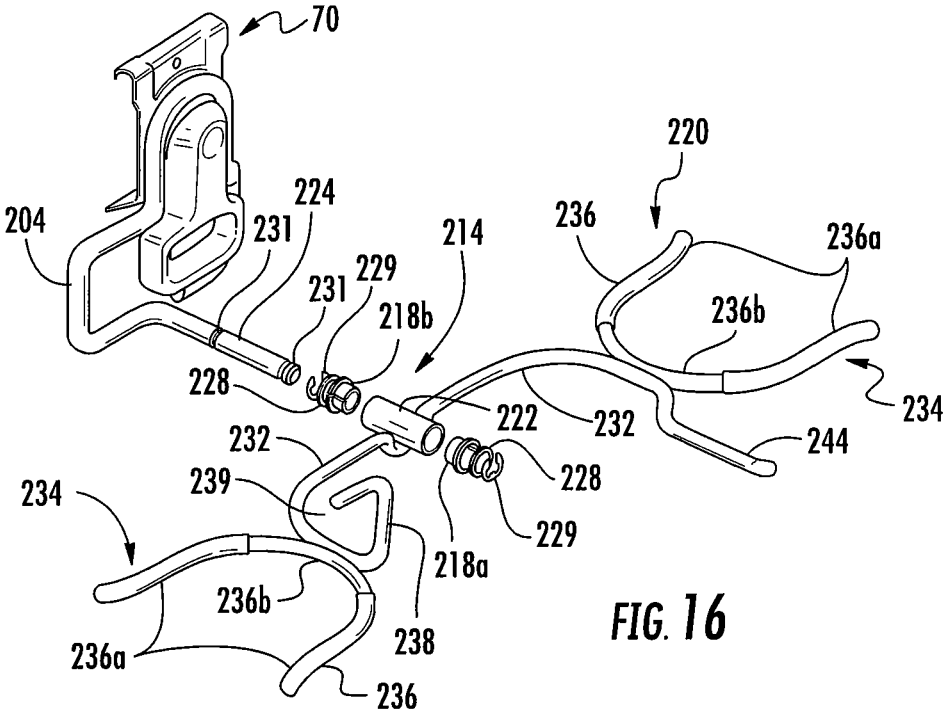
FIG. 16 is an exploded view of the cord winder accessory of FIG. 15.
Figure 17:
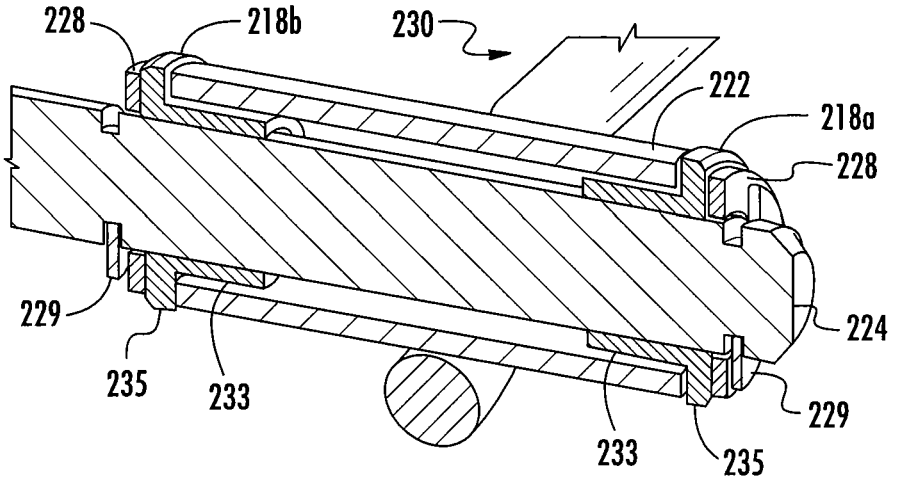
FIG. 17 is a partial section view of the rotating joint of the cord winder accessory of FIG. 15.

Referring more specifically to FIG. 16, the rotating joint 214 comprises a horizontally extending stud 224 that extends from the support 204. In one embodiment the support 204 and stud 224 are made of one-piece member such as the illustrated wireform where the wireform is configured such that the end of the wireform extends substantially horizontally away from the gripper assembly 40 to form the stud 224. The sleeve 222 of the spooling mechanism 220 fits over the stud 224 such that the sleeve 222 may rotate relative to the stud 224. In other embodiments these elements may be reversed where the sleeve extends from the support 204 and the stud is formed on the spooling mechanism 220.

To mount the sleeve 222 of the spooling mechanism 220 over the stud 224 a bushing 218*a* and 218*b* is located in each end of the sleeve 222. The bushings 218*a* and 218*b* may comprise plastic bushings and may be ABS plastic. A washer 228 is located between the bushings and the retaining clips 229 to protect the retaining clips. The retaining clips may comprise E-style retaining clips that are force fit onto the stud 224 and engage grooves 231 formed on the stud 224 to lock the spooling mechanism 220 on the stud 224.

Figure 18:
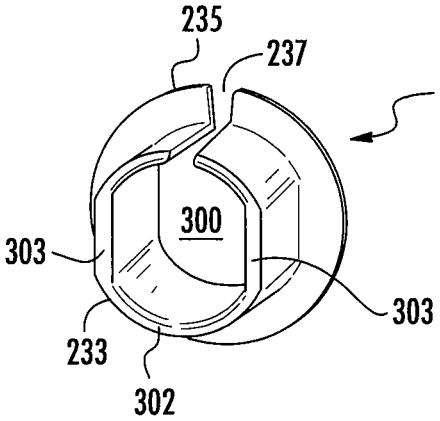
FIG. 18 is a perspective view of a bushing usable in various embodiment of the cord winder of the invention.
Figure 19:
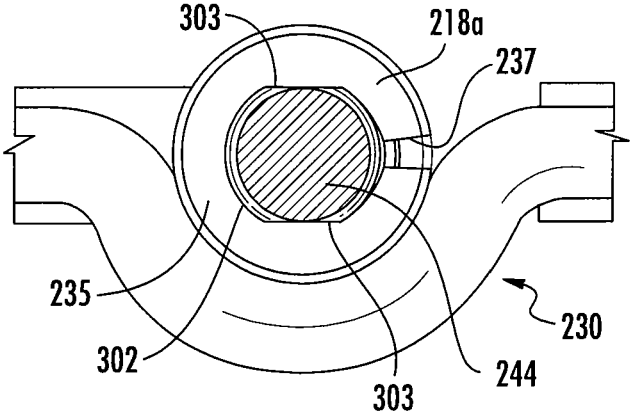
FIG. 19 is an end view of the arrangement of the bushing and stud.
Figure 20:
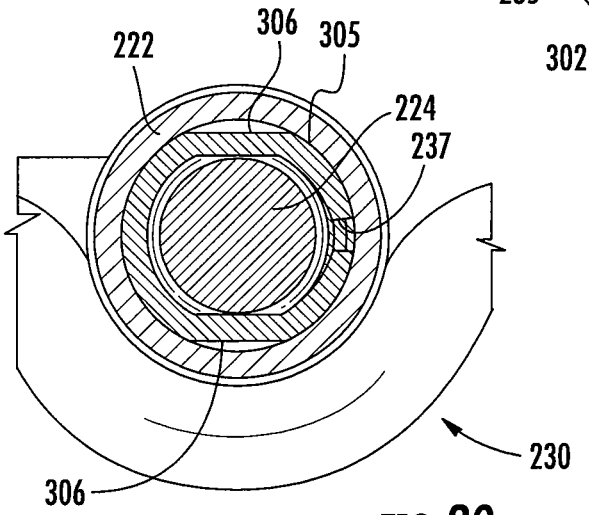
FIG. 20 is a section view showing the arrangement of the bushing and stud.

In one embodiment the bushings 218*a* and 218*b* are used to control the rotation of the sleeve 222 on the stud 224 to prevent the spooling mechanism 220 from freely spinning on the stud 224. Each bushing 218*a* and 218*b* is formed as a stepped cylindrical bushing having a smaller outer diameter portion 233 that fits into the sleeve 222 and a larger outer diameter portion 235 that abuts the sleeve 222 to position the bushing in the sleeve as shown in FIG. 18. The bushing further comprises a slot 237 that extends through the bushing such that the bushing may be compressed during assembly of the rotating joint 214. In one embodiment the internal bore 300 of the bushing is formed with a cylindrical surface 302 having a flat or a plurality of flat surfaces 303 formed therein. Likewise, the external surface of portion 233 includes a cylindrical surface 305 having a flat or a plurality of flat surfaces 306 formed therein. When the bushing is compressed between the stud 224 and the sleeve 222 the flat surfaces 303 contact the stud 224 but the cylindrical surface 302 does not contact the stud 224, and the cylindrical surface 305 contacts the sleeve 222 but the flat surfaces 306 do not contact the sleeve 222. The amount of surface area contact between the bushings and the sleeve 222 and stud 224 and the amount of force exerted on these components from the compression of the bushings between the sleeve 222 and stud 224 determines the amount of friction added to the system. The bushings 218*a* and 218*b* create an interference fit between the sleeve 222 and the stud 224. The friction generated by the interference fit slows the rotation of the sleeve 222 relative to the stud 224 such that the sleeve does not freely rotate on the stud. Because the sleeve 222 does not freely spin on the stud 224, the spooling mechanism 220 is prevented from accidently rotating and unwinding the cord. While the interference fit between the stud and the sleeve prevents the free rotation of the spooling mechanism, the interference fit is selected such that when a user applies a force to the spooling mechanism 220 the spooling mechanism may be rotated to wind or unwind the cord. The amount of friction added to the system may be determined to allow the spooling mechanism 220 to spin more or less freely as desired. The interference fit may be used with any embodiment of the invention to prevent the free spinning of the spooling mechanism Operation of the winder of the invention will be described. The cord winder accessory may be mounted in a stationary position on a wall or other surface. In one embodiment, the winder assembly is mounted on a rail 2 using a gripper assembly 40 as previously described. Once mounted on the rail, the cord winder accessory 1 may be operated with two hands. One end of the cord is inserted into the cord holder 238 with the cord disposed in one of the cord retainers 234. The cord may be guided into the spooling mechanism 220 with one hand while the spooling mechanism is wound with the other hand using the handle 244. The cord may be wound onto the spooling accessory by rotating the spooling mechanism 220. Once the cord is completely wound on the spooling mechanism 220 the free end of the cord may be woven under itself to hold the free end of the cord in place. To use the cord remote from the wall, the gripper assembly 40 may be removed from the rail and the cord transported on the cord winder accessory.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A winder accessory for use in a rail storage system, the rail storage system comprising a rail configured to be mounted to a vertical surface, the rail comprising a first horizontally extending channel and a second horizontally extending channel spaced vertically from the first horizontally extending channel, the winder accessory comprising:

a gripper assembly adapted to be releasably attached to the rail, the gripper assembly comprising a support having a downwardly facing hook that engages the first channel, and a movable latch that engages the second channel, the movable latch being rotatable, relative to the support, between a first position where the latch engages the second channel and a second position where the latch is disengaged from the channel such that the gripper assembly may be removed from the rail; and a cord winder mechanism supported on the gripper assembly and comprising a support fixed to the gripper assembly and a spooling mechanism for winding a cord, the spooling mechanism being rotatable at a rotating joint relative to the support of the cord winder mechanism about a first axis, the first axis being disposed substantially horizontally and substantially perpendicular to a length of the vertical surface when the gripper assembly is mounted on the rail, and the spooling mechanism being further rotatable relative to the support of the cord winder mechanism about a second axis that is different from the first axis; the second axis is substantially perpendicular to the length of the vertical surface and substantially parallel to a height of the vertical surface when the gripper assembly is mounted on the rail.

2. The winder accessory of claim 1 wherein the spooling mechanism comprises a wireform support structure comprising at least one arm where a distal end of the wireform support structure is bent to form a plug holder.

3. The winder accessory of claim 1 wherein the spooling mechanism comprises a wireform support structure comprising at least one arm where a first end of the wireform support structure is bent to form a handle.

4. The winder accessory of claim 3 wherein a second end of the wireform support structure is bent to form a plug holder.

5. The winder accessory of claim 2 wherein the support structure comprises two arms spaced from one another about the rotating joint.

6. The winder accessory of claim 5 wherein the spooling mechanism comprises a pair of cord retainer mechanisms, one of the cord retainer mechanisms being mounted to each of the arms.

7. The winder accessory of claim 6 wherein the cord retainer mechanisms comprise substantially U-shaped members secured to the arms such that the open ends of the U-shaped members extend outwardly.

8. The winder accessory of claim 6 wherein the cord retainer mechanisms comprise a pair of spaced legs that extend away from the support arms.

9. The winder accessory of claim 8 wherein ends of the legs are flared outwardly to facilitate the capture of the cord when the spooling mechanism is rotated.

10. The winder accessory of claim 1 wherein the rotating joint comprises a stud extending from the support and defining the first axis and a sleeve where the sleeve fits over the stud such that the sleeve rotates over the stud.

11. The winder accessory of claim 10 further comprising a bushing located between the stud and the sleeve such that the sleeve rotates on the bushing.

12. The winder accessory of claim 11 wherein the bushing comprises a slot that extends through the bushing such that the bushing may be compressed between the sleeve and the stud.

13. The winder accessory of claim 11 wherein the bushing creates an interference fit between the sleeve and the stud where friction generated by the interference fit slows the rotation of the sleeve relative to the stud such that the sleeve does not freely rotate relative to the stud.

14. A cord winder accessory for use in a rail storage system, the rail storage system comprising a rail configured to be mounted to a vertical surface, the cord winder accessory comprising:

a gripper assembly adapted to be releasably attached to the rail, the gripper assembly comprising a latch movable between a first position where the latch engages the rail and a second position where the latch is disengaged from the rail such that the gripper assembly may be removed from the rail; and a cord winder mechanism supported by the gripper assembly, the cord winder mechanism comprising a support coupled to the gripper assembly and a spooling mechanism for winding a cord, the support being supported by the gripper assembly, the spooling mechanism being rotatable relative to the support about a first axis of rotation, and a pivot joint between the spool mechanism and the gripper assembly allowing the spool mechanism to pivot relative to the gripper assembly about a second axis of rotation, wherein the spooling mechanism comprises a bearing sleeve that is fitted over a portion of the cord winder mechanism and is rotatable relative to that portion of the cord winder mechanism, a pair of arms extending outwardly from the bearing sleeve, and a cord retainer structure comprising a pair of substantially U-shaped members extending outwardly from the pair of arms, respectively, the cord retainer structure adapted to retain the cord.

15. The winder accessory of claim 14 wherein the pivot joint detaches the cord winder mechanism from the gripper assembly such that the spool mechanism is removable from the gripper assembly without removing the gripper assembly from the rail.

16. The winder accessory of claim 15 wherein the pivot joint comprises a stud that is releasably inserted into a vertically oriented sleeve along the second axis of rotation.

17. The winder accessory of claim 16 wherein the stud comprises a first end and a second end where each of the first end and the second end are releasably insertable into the sleeve.

18. The winder accessory of claim 16 wherein the second axis of rotation is disposed substantially vertically and the first axis of rotation is disposed substantially horizontally.

19. A cord winder accessory for use in a rail storage system, the rail storage system comprising a rail configured to be mounted to a vertical surface, the cord winder accessory comprising:

a gripper assembly adapted to be releasably attached to the rail, the gripper assembly comprising a latch movable between a first position where the latch engages the rail and a second position where the latch is disengaged from the rail such that the gripper assembly may be removed from the rail; and a cord winder mechanism supported by the gripper assembly, the cord winder mechanism comprising a support coupled to the gripper assembly, a winder body pivotably coupled to the support, and a spooling mechanism for winding a cord, the spooling mechanism and the winder body being pivotable relative to the support about a first axis of rotation, and the spool mechanism being pivotable relative to the gripper assembly about a second axis of rotation different from the first axis of rotation, wherein the cord winder mechanism further comprises a post having a first end, a second end, and a central portion between the first and second ends, one of the first and second ends being received by a portion of the support to pivotably couple the winder body to the support, the winder body coupled to the central portion of the post and extending outwardly from the central portion of the post in a direction that is substantially perpendicular to the first axis of rotation.

20. The cord winder accessory of claim 19, wherein the spool mechanism is pivotable relative to the support, the winder body, and the gripper assembly about the second axis of rotation.

21. The cord winder accessory of claim 14, wherein the portion of the cord winder mechanism further comprises a winder body pivotably coupled to the support, the winder body comprising an outwardly extending stud, the bearing sleeve being fitted over the outwardly extending stud of the winder body.

* * * * *